United States Patent [19]

Bühler et al.

[11] Patent Number: 4,721,450

[45] Date of Patent: Jan. 26, 1988

[54] DEVICE FOR PRODUCING CERAMIC MOULDINGS WITH SPRING MOUNTED INJECTION HEAD

[75] Inventors: Eugen Bühler, Burtenbach; Klaus Strobel; Karl Schwarzmeir, both of Selb, all of Fed. Rep. of Germany

[73] Assignee: Eugen Buhler & Hutschenreuther AG

[21] Appl. No.: 860,519

[22] Filed: May 7, 1986

[30] Foreign Application Priority Data

May 14, 1985 [DE] Fed. Rep. of Germany ..... 3517447

[51] Int. Cl.[4] ..... B30B 9/28

[52] U.S. Cl. ..... 425/405 H; 264/60; 425/412

[58] Field of Search ..... 249/65; 425/33, 40, 425/51, 405 R, 405 H, 406, 407, 412, 457, 383, 384, 389, 390, DIG. 14, DIG. 19, DIG. 44, DIG. 110, DIG. 112; 100/93 P, 211, 269 A, 268; 264/56, 60, 64–66

[56] References Cited

U.S. PATENT DOCUMENTS

| | | | |
|---|---|---|---|
| 4,043,730 | 8/1977 | Bettonica | 425/DIG. 19 |
| 4,157,887 | 6/1979 | Söthje | 425/405 H |
| 4,473,526 | 9/1984 | Bühler et al. | 264/517 |
| 4,588,368 | 5/1986 | Bühler et al. | 425/405 H |

FOREIGN PATENT DOCUMENTS

| | | |
|---|---|---|
| 3101236 | 1/1982 | Fed. Rep. of Germany . |
| 3128348 | 2/1983 | Fed. Rep. of Germany . |
| 2554040 | 5/1985 | France . |
| 285103 | 2/1928 | United Kingdom . |
| 1042995 | 9/1966 | United Kingdom . |
| 1370201 | 10/1974 | United Kingdom . |
| 1442041 | 7/1976 | United Kingdom . |
| 1451525 | 10/1976 | United Kingdom . |
| 2148782 | 6/1985 | United Kingdom . |

*Primary Examiner*—Jay H. Woo
*Assistant Examiner*—J. L. Fortenberry
*Attorney, Agent, or Firm*—Toren, McGeady & Associates

[57] ABSTRACT

A device for producing ceramic mouldings is disclosed comprising an isostatic press-mould half having an isostatic pressure membrane and an injection head having an inlet opening for introducing granulate and an extraction orifice for sucking the granulate in or out of the mould cavity. The injection head is spring-mounted on a press crosspiece which supports it, so that, as the injection head moves towards the isostatic press-mould half, a sealing pressure slowly forms between the injection head and the isostatic press-mould half and as the injection head moves away from the isostatic press-mould half this sealing pressure is slowly reduced.

12 Claims, 3 Drawing Figures

DEVICE FOR PRODUCING CERAMIC MOULDINGS WITH SPRING MOUNTED INJECTION HEAD

BACKGROUND OF THE INVENTION

This invention relates to a device for producing ceramic mouldings.

In German Patent Specification No. 3,101,236 there is disclosed a device for producing ceramic mouldings comprising two half-moulds which are adjustable between a relatively open position and a relatively closed position by means of two parts of an adjusting device, especially a press, these two parts being movable in relation to each other, and these two parts defining between them a mould cavity which is closed in the relatively closed position, the mould cavity having at least one inlet opening for particulate, ceramic moulding compositions, at least one extraction orifice and possibly a fluidizing air inflow opening, cooperating sealing surfaces being provided on sealing surface carriers of the mould halves which are movable in relation to each other, said sealing surfaces coming together during the closing motion of the adjusting device, separating during the opening movement of the adjusting device and sealing the mould cavity in the relatively closed position.

In the device of German Patent Specification No. 3,101,236, a vacuum is created in the closed mould cavity to draw in the particulate ceramic moulding composition. The particulate ceramic composition is sucked into the mould cavity by this vacuum, its distribution in the mould chamber being assisted by the introduction of fluidizing air into the moulding composition at the point where it enters the mould cavity or at a nearby point. In German Patent Specification No. 3,101,236 a procedure is disclosed in which the impact velocity of the moulding composition particles sucked in against the extraction orifices at the start of the suction process is kept low by a set of filters formed as part of the mouldings at the extraction orifices. This set of filters allows the further extraction of air by preventing obstruction of these extraction orifices by too densely packed moulding composition particles which may also have been destroyed on impact. By means of the process according to German Patent Specification No. 3,101,236 it was possible for the first time to achieve by suction a satisfactory filling of the mould cavity with a moulding composition and furthermore to precompress the moulding composition in the mould cavity during suction to such an extent that certain manipulations are possible without the pre-moulding being damaged. In particular, it has proved possible to replace the injection head, by means of which a vacuum is first created and then the moulding composition and possibly the fluidizing air are supplied, by a pressing head, without any large-scale destruction of the pre-moulding occurring during the replacement of the injection head by the pressing head. Nevertheless the pre-moulding has randomly yet repeatedly shown signs of damage caused when the injection head is removed, a fact which has not hitherto been explicable.

It has now been discovered that a considerable reduction in damage caused to the pre-moulding when the injection head is removed can be achieved by a relatively simple measure.

This relatively simple measure consists, for a device as described, in providing a spring suspension system between at least a part of the adjusting device and the sealing surface carrier of the corresponding mould half. This spring system is stressed during the closing motion of the adjusting device and relaxes during the opening movement of the adjusting device.

SUMMARY OF THE INVENTION

According, therefore, to the present invention, there is provided a device for producing ceramic mouldings comprising two mould halves which are adjustable between a relatively open position and a relatively closed position, the mould halves defining a mould cavity which is closed in the relatively closed position; an adjusting device for effecting the adjustment of the mould halves, the adjusting device having two parts which are movable in relation to each other; the mould cavity having at least one inlet opening for particulate ceramic material and at least one extraction orifice; the relatively movable mould halves having sealing surface carriers respectively provided with cooperating sealing surfaces, said sealing surfaces coming together during the closing motion of the adjusting device, separating during the opening movement of the adjusting device and sealing the mould cavity in the relatively closed position; and a spring suspension system disposed between at least one part of the adjusting device and the sealing surface carrier of the corresponding mould half, the spring suspension system being stressed during the closing motion of the adjusting device and relaxing during the opening movement of the adjusting device.

The mould cavity may also have a fluidizing air inflow opening.

The device of the present invention may be operated so that the seal arising between the two mould halves is gradually put under pressure during the transfer of the mould halves into the relatively closed position. Similarly, the sealing pressure may be only gradually released when the two mould halves are separated from each other.

The arrangement may be such that, while the spring system is fully compressed, the seal is under full sealing pressure. When the parts of the adjusting device which support the mould halves begin to move away from each other, the sealing pressure decreases gradually from its full value to zero, this being reached when the previously compressed spring system is completely relaxed. With this gradual removal of sealing pressure the possibility arises of a gentle pressure equalization between the atmosphere and the mould cavity. This gentle pressure equalization is a reason why fewer mouldings than previously are damaged or destroyed when the mould halves are separated from each other, although the reasons for this advantageous occurrence are not totally clear and other reasons may exist in addition to the one mentioned above.

The spring system can preferably be compressed in the fully compressed state until it "locks", or stops may be provided which span the spring system, so that a sealing pressure is transmittable which is greater than the sealing pressure produced by the spring system in the state of greatest compression. The arrangement may be such that, even when the springs are in their most relaxed state, a certain degree of initial stress is present in the spring system.

One of the two mould halves is preferably constructed as an isostatic press-mould half having an isostatic pressure membrane one side of which defines a part of the mould cavity and a second side of which is acted upon by pressure fluid, especially hydraulic fluid, the other mould half comprising a vacuum injection head with a surface defining a part of the mould cavity opposite the pressure membrane. This mould defining surface may contain the inlet opening, the extraction orifice and, if present, the fluidizing air inflow opening. In this embodiment the sealing surface carriers can be formed from an edge area of the isostatic pressure membrane and a membrane contacting ring on the injection head adjacent to the edge area of the isostatic pressure membrane.

The inlet opening for the ceramic moulding composition can be so positioned in the injection head that it opens into a central region of the mould cavity, while the extraction orifice may be located in the injection head in such a way that it opens into the mould cavity in an edge area of maximum peripheral extension. This arrangement leads, as practical experience has revealed, to complete filling of the mould cavity and to approximately uniform density of the moulding throughout its volume.

The mould cavity may be evacuated to a pressure of 0.7 to 0.1 bar. For the same reasons as in the construction described in German Patent Specification No. 3,101,236, the impact velocity of the moulding composition particles drawn in against the extraction orifice is preferably kept within limits. This may be done by means of the introduction of infiltrated air into a suction line connected to the extraction orifices and/or into the mould cavity. It is also possible to control the impact velocity of the moulding composition particles drawn in against the extraction orifices by throttling the extracted air. Particular care must be taken to control the impact velocity of the moulding composition in such a way that at least a part of the moulding composition particles remain undestroyed. Thus in the case of a moulding composition having grains of different sizes, the relatively large individual grains should remain undestroyed.

Materials which may be used as moulding compositions are especially pelleted ceramic compositions, in particular ceramic compositions pelleted by spray-drying, as described in German Patent Specification No. 3,101,236.

The mould halves can be vertically movable in relation to each other. If so, the lower mould half is preferably formed from an isostatic press-mould half and the upper mould half from an injection head.

The sealing surface carrier supported by the spring suspension system can be attached rigidly to the corresponding mould half. In this case, this mould half can be supported on the part of the adjusting device which supports it by a plurality of compression springs arranged around its circumference.

The compression springs can be replaced by sets of cup springs or the like.

The mould half supported by the spring suspension system can be fitted to the part of the adjusting device which supports it by a plurality of guide bolts.

As a rule the injection heads according to German Patent Specification No. 3,101,236 are only suitable for forming a moulding and not for final pressing. For this reason it can be arranged for the vacuum injection head to be replaceable, after the mould cavity is filled, by a pressing head. It should however be pointed out that in principle it is also possible to effect pressing inside the mould halves in which the pre-moulding is formed.

The construction of the device is facilitated if the injection head is supported by the spring suspension system on a part of the adjusting device. This means that the isostatic press-mould part can be rigidly secured to the adjusting device, i.e. in particular to the press.

As regards the careful removal of the moulding formed in the mould cavity, it is recommendable that a drive control associated with the driving mechanism of the adjusting device ensure, during the opening movement of the adjusting device, a first, lower opening speed, until the spring system is relaxed or until shortly after it is relaxed, and then a second, higher opening speed. This higher opening speed is desirable so as to obtain a high cycle rate. On the other hand, the lower opening speed at the beginning of the opening motion ensures a slow removal of the vacuum inside the mould cavity.

BRIEF DESCRIPTION OF THE DRAWINGS

The invention is illustrated, merely by way of example, in the accompanying drawings, in which.

DESCRIPTION OF THE PREFERRED EMBODIMENT

Figure 1:
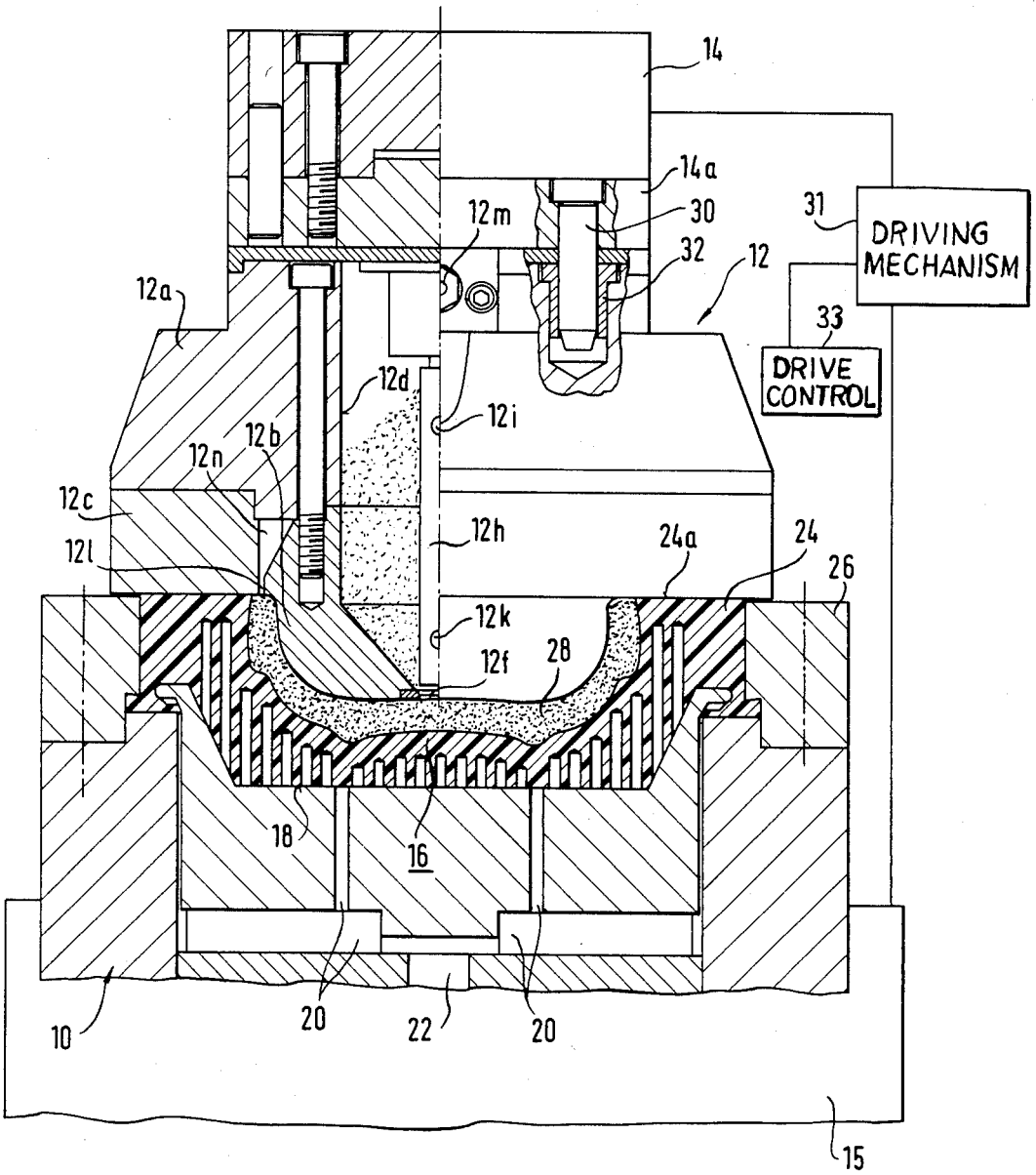
FIG. 1 shows a device according to the invention for producing ceramic mouldings, part of FIG. 1 being a section on the line I—I of FIG. 3.

In FIG. 1 there is shown a device for producing ceramic mouldings comprising a lower press-mould half which is indicated generally by 10 and an injection head which is indicated generally by 12. The lower press-mould half 10 stands on a basic frame 15 of a ceramic press, for example an hydraulic ceramic press. The basic frame 15 and a crosspiece 14 together form an adjusting device 15, 14 for adjusting the mould halves 10, 12 relatively to each other. The injection head 12 is arranged on the crosspiece 14 of the press or adjusting device 15, 14, the crosspiece 14 being fitted in the usual way on a guide frame (not shown) of the adjusting device or press 15, 14. A driving mechanism which moves the two parts 14 and 15 of the adjusting device 15, 14 in relation to each other in the vertical direction is indicated at 30. The driving mechanism 31, which is for example, a hydraulic driving mechanism, is provided with drive control means 33.

The lower mould half comprises an isostatic pressure membrane 16 located in a pressure chamber 18 in the lower mould half 10. The pressure chamber 18 is connected by distributor channels 20 to an hydraulic pressure fluid connection 22. A sealing edge 24 of the pressure membrane 16 is attached to the mould half 10 by means of a connecting flange 26. The sealing edge 24 constitutes a sealing surface carrier having a sealing surface **24*a***.

Figure 2:
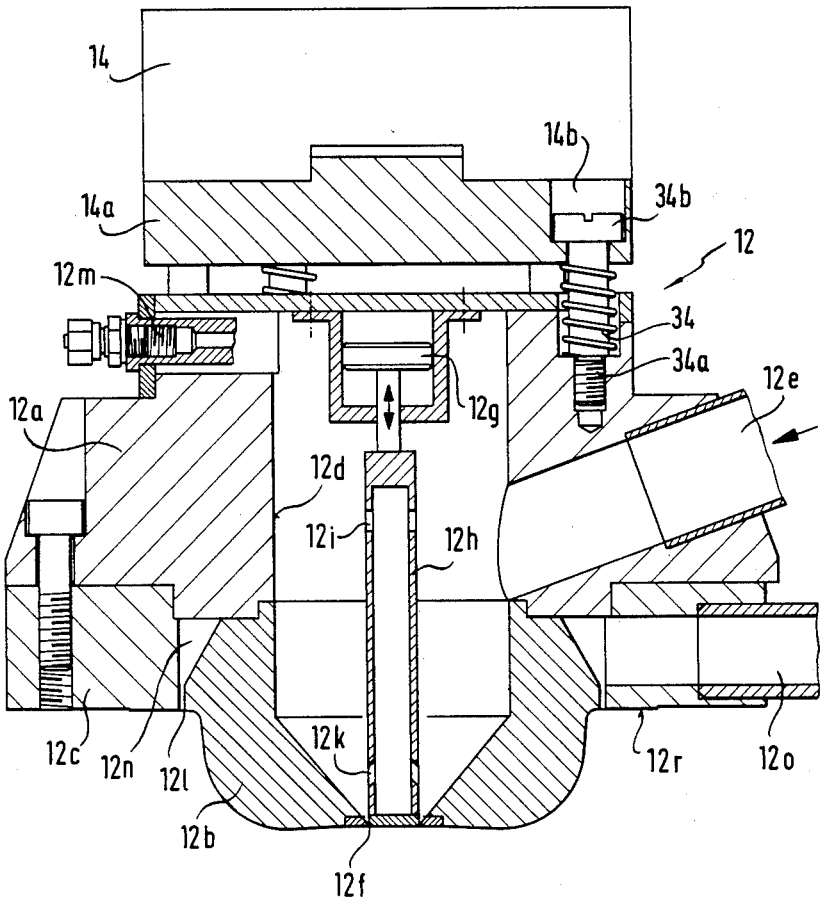
FIG. 2 is a cross-section on the line II—II of FIG. 3, through an injection head which is part of the device of FIG. 1.
Figure 3:
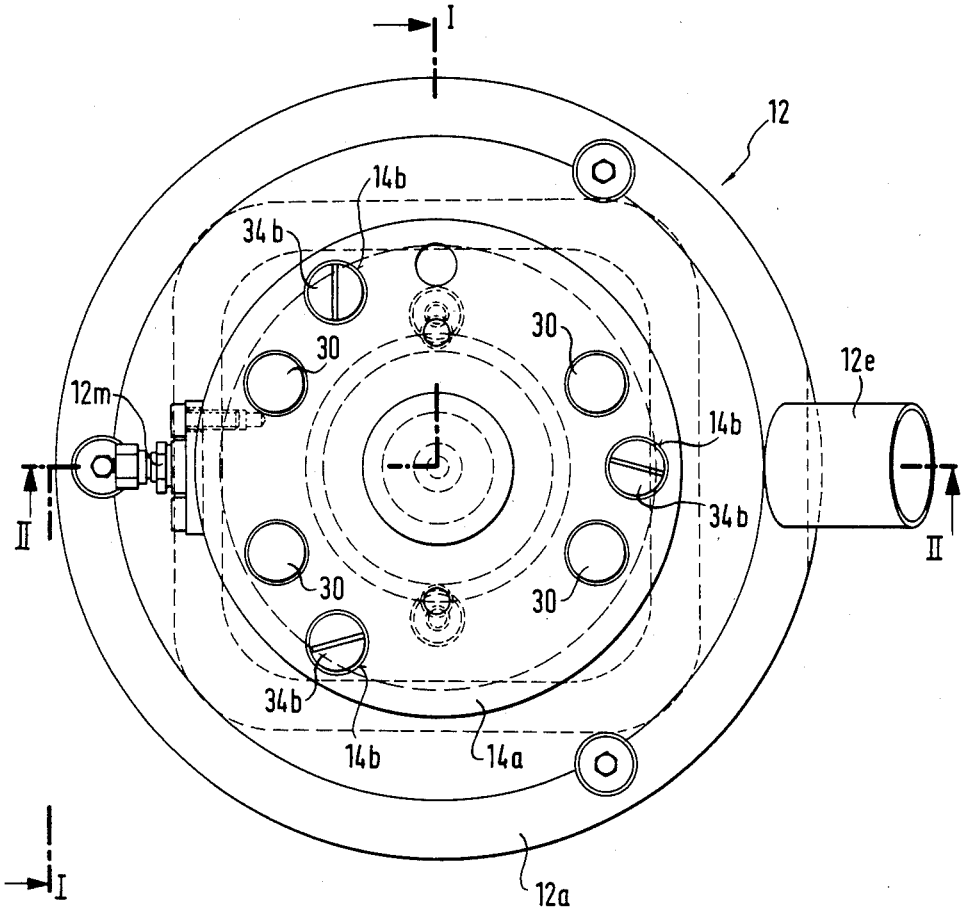
FIG. 3 is a plan view of the injection head of FIG. 2.

The injection head 12 comprises a main body **12*a*, a central mould body 12*b* and a membrane contacting ring 12*c*. The two parts 12*b* and 12*c* are rigidly connected to the part 12*a* by means not shown. The membrane contacting ring 12*c* constitutes a sealing surface support having a sealing surface 12*r* (FIG. 2**).

Inside the main body **12*a* and the central mould body 12*b* there is defined an inlet chamber 12*d* for particulate ceramic moulding-compositions, said chamber being connected to a composition supply by a supply line 12e. In the centre of the central mould body 12b there is provided an inlet opening 12f which is closable by a sealing and fluidizing pipe 12h. In FIG. 2 the sealing and fluidizing pipe 12h is in the sealing position. The sealing and fluidizing pipe is vertically adjustable in the direction of the double-headed arrow by means of a pneumatic power apparatus 12g, is hollow and has upper and lower fluidizing air openings 12i and 12k through which fluidizing air conveyed by a fluidizing air connection 12m can enter the particulate ceramic moulding composition near the inlet opening 12f**.

Between the central mould body 12b and the membrane contacting ring 12c there is defined an annular gap 12l which is connected to an annular chamber 12n. The annular gap 12l serves as an extraction orifice the significance of which will be considered below. The annular chamber 12n is connected to a negative pressure vessel by a vacuum line 12o.

In FIG. 1 the injection head 12 is in the sealing position with respect to the mould half 10 (the seal between the sealing edge 24 and the membrane contacting ring 12c being completely effective with the sealing surfaces 24a and 12r adjacent to each other). A mould cavity is formed between the pressure membrane 16 and the central mould body 12b.

A sliding guide is arranged between the crosspiece 14 and the main body 12a of the injection head 12 and is constructed from a plurality of sliding bolts 30 on a part 14a of the crosspiece 14. The sliding bolts 30 engage in sliding bushings 32 in the main body 12a (FIG. 1).

As may be seen from FIG. 2, a spring suspension system is arranged between the part 14a of the crosspiece 14 and the main body 12a of the injection head 12, the spring suspension consisting of a plurality of compression springs 34. The compression springs 34 are fitted on guide bolts 34a which are screwed into the main body 12a. The guide bolts 34a have bolt heads 34b which can fit into countersunk bores 14b in the part 14a. The spring suspension system 34 acts between the part 14 and the sealing surface carrier 12c.

In the position shown in FIG. 2, the injection head 12 is separated from the part 14a of the crosspiece 14 by the operation of the compression springs 34. In the position shown in FIG. 1, the crosspiece 14 has dropped so far that the compression springs 34 are fully compressed. The membrane contacting ring or sealing surface 12c is thus pressed onto the sealing edge or sealing surface carrier 24 through the operation of the compressed compression springs 34. In the state according to FIG. 1 the mould cavity 28 is filled. To this end, the sealing and fluidizing pipe 12h is brought into the position shown in FIG. 1, in which the inlet opening 12f is open. A vacuum is formed in the annular chamber 12n by the vacuum line 12o, so that a vacuum is created in the mould cavity 28 via the annular gap 12l (suction opening). Through the effect of this vacuum, particulate ceramic, moulding composition is sucked from the supply chamber 12d through the inlet opening 12f and into the mould cavity 28. The even distribution of the moulding composition in the mould cavity 28 is assisted by fluidizing air which is admitted to the supply chamber 12d at 12m and enters the moulding composition at 12k in the vicinity of the inlet opening 12f through the sealing and fluidizing pipe 12h. The fluidizing air helps the even distribution of the particulate-ceramic composition in the mould cavity 28. As soon as the filling of the mould cavity 28 is completed, the crosspiece 14 is raised. The injection head 12 and the sealing surface carrier 12c at first retain their positions as shown in FIG. 1 and the compression springs 34 relax gradually so that the sealing pressure between the sealing surfaces 24a and 12r is slowly reduced. While this sealing pressure is decreasing and moving towards zero, atmospheric pressure can penetrate through the sealing surfaces 24a, 12r into the mould cavity 28 so that this is gradually pressurized. To this gradual pressurization can be attributed the fact that, during separation of the injection head 12 from the lower mould half 10, i.e. during separation of the central mould body 12b from the moulding formed in the mould cavity 28, no disintegration of or damage to the pre-compressed moulding occurs. It is assumed that complete pressurization of the moulding was not possible merely by connecting the vacuum pipe 12o to the atmosphere and that the gradual release of the seal between the sealing edge 24 and the membrane contacting ring 12c therefore leads to careful treatment of the pre-pressed moulding. It may be the case that the slow release of the pressure exerted by the central mould body 12b is also responsible for the careful treatment of the pre-pressed moulding.

When the compression springs 34 have relaxed, the injection head 12 can be completely removed and replaced by a pressing head, whose central mould body corresponds approximately to the central mould body 12b. Once this pressing head has been inserted, isostatic pressing occurs. i.e. a highly pressurized fluid is sent through the pressure fluid connection 22 via the distributor channels 20 to the rear side of the pressure membrane 16 in the pressure chamber 18 and the pre-pressed moulding is given its final pressing.

In FIG. 1 a plurality of notches can be seen in the pressure membrane 16. These notches are filled with pressure fluid and are intended to relieve the thick-walled pressure membrane 16 of internal stresses and in addition also to provide the membrane with structural stability, which facilitates the production of a moulding with a desired outer shape.

As shown in FIG. 1, when the compression springs start to relax, the drive control means 33 ensures a slow relative motion of the parts 15 and 14, so that the vacuum in the mould cavity 28 is reduced even more slowly and the pre-moulding produced is pressurized even more carefully. Only when or shortly after the springs 34 are relaxed does the drive control means 33 cause the part 14 to rise more rapidly. In this way the careful treatment of the pre-moulding produced by slow pressurization of the mould cavity 28 is combined optimally with a high working speed of the whole device.

Finally, it should also be noted that, at the same time as a vacuum is created in the mould cavity 28 in order to draw in the moulding composition, a vacuum can also be created below the pressure membrane 16, in order to ensure that the pressure membrane 16 remains in contact with the lower mould half despite the vacuum in the mould cavity 28 and that the mould cavity is not deformed by the vacuum within it.

What is claimed is:

1. A device for producing ceramic moldings comprising a first mold carrier carrying a first mold unit, a second mold carrier carrying a second mold unit, mold carrier moving means operatively connected with said first mold carrier and with said second mold carrier a spring suspension system being provided between one of said first and second mold carriers and the respective mold unit, said first and said second mold carriers being movable by said mold carrier moving means through a path of relative movement between a first relative position and a second relative position, said first mold unit and said second mold unit defining in said second relative position of said mold carriers a closed mold cavity, said mold cavity being open in said first relative position, said first and said second mold units being provided with respective sealing faces sealingly engaging each other in said second relative position of said mold carriers such as to seal said mold cavity against atmosphere, said spring suspension system being stressed at a maximum in said second relative position of said mold carriers and being at least partially relaxed in said first relative positive of said mold carriers, said spring suspension system maintaining engagement of said sealing faces for a predetermined portion of said path of relative movement of said mold carriers when said mold carriers relatively move from said second relative position to said first relative position, the pressure of engagement of said sealing faces decreasing during said predetermined portion of said path of movement, said mold cavity being provided with at least one evacuation orifice for evacuating said mold cavity in said second relative position, said mold cavity being further provided with at least one inlet opening for admitting particulate ceramic material into said closed mold cavity under the suction action of said vacuum within said closed mold cavity.

2. A device according to claim 1 in which the mold cavity has a fluidizing air inflow opening.

3. A device according to claim 1 in which one of the two mold units comprises an isostatic pressure membrane which, on a first side thereof, defines a part of the mold cavity and, on a second side thereof, is acted on by hydraulic pressure fluid, the other mold unit comprising a vacuum injection head having a mold defining surface defining a part of the mold cavity opposite the pressure membrane, said mold defining surface containing said inlet opening and said evacuation orifice.

4. A device according to claim 3 in which one of said sealing faces is established by an edge area of said isostatic pressure membrane, and another sealing face is defined by an annular sealing member of said vacuum injection head.

5. A device according to claim 3 in which the inlet opening communicates with a central region of said mold cavity, said evacuation orifice communicating with the mold cavity at an edge area of substantially maximum peripheral extension.

6. A device according to claim 1 in which said mold carriers are substantially vertically movable in relation to each other.

7. A device according to claim 3 in which a lower mold unit comprises said isostatic pressure membrane and an upper mold unit comprises said injection head.

8. A device according to claim 1 wherein the sealing face supported by said spring suspension system is fixed rigidly to the corresponding mold unit, and said spring suspension system comprises a plurality of compression springs arranged between said corresponding mold unit and the one of said first and second mold carriers supporting said corresponding mold unit.

9. A device according to claim 8 wherein said mold unit supported by said spring suspension system is secured by a plurality of guide bolts to the one of said first and second mold carriers supporting said corresponding mold unit.

10. A device according to claim 8 wherein a vacuum injection head is supported by said spring suspension system on the one of said first and second mold carriers supporting said corresponding mold unit.

11. A device according to claim 1 in which the mold carrier moving means are controlled by moving control means which impose to said mold carriers a smaller relative mold cavity opening speed during said predetermined path of movement and a higher mold cavity opening speed beyond said predetermined path of movement.

12. A device for producing ceramic moldings comprising two mold units having a common axis, each of said mold units having a mold surface and an annular sealing member with respective sealing faces surrounding the respective mold surfaces and being substantially perpendicular to said axis, moving means operatively connected with said mold units by respective connection means, said moving means being movable through a path of movement from a first operative position, in which said sealing faces are spaced from each other, to a second operative position, in which said sealing faces are in sealing engagement and a closed cavity is defined by said mold surfaces, a spring suspension system being provided in at least one of said connection means between said moving means and the respective sealing member, said spring suspension system being stressed at a maximum when said moving means are in said second operative position and being at least partially relaxed when said moving means are in said first operative position, said sealing engagement of said sealing faces being mantained by said spring suspension system with decreasing sealing pressure when said moving means are moved from said second operative position to said first operative position during a predetermined portion of said path of movement, which portion is adjacent said second operative position, said mold cavity being provided with at least one evacuation orifice for evacuating said mold cavity in said second relative position, said mold cavity being further provided with at least one inlet opening for admitting particulate ceramic material into said closed mold cavity under the suction action of said vacuum within said closed mold cavity.

* * * * *

UNITED STATES PATENT AND TRADEMARK OFFICE

CERTIFICATE OF CORRECTION

PATENT NO. : 4,721,450

DATED : January 26, 1988

INVENTOR(S) : Eugen Bühler et al

It is certified that error appears in the above-identified patent and that said Letters Patent is hereby corrected as shown below:

In the heading of the Patent, it should read:

[75] Inventors: Eugen Bühler, Klaus Strobel, Karl Schwarzmeier

Signed and Sealed this

Twenty-first Day of June, 1988

*Attest:*

*Attesting Officer*

DONALD J. QUIGG

*Commissioner of Patents and Trademarks*

UNITED STATES PATENT AND TRADEMARK OFFICE

CERTIFICATE OF CORRECTION

PATENT NO. : 4,721,450

DATED : January 26, 1988

INVENTOR(S) : Eugen Bühler et al

It is certified that error appears in the above-identified patent and that said Letters Patent is hereby corrected as shown below:

In the heading of the Patent, it should read:

[30] Foreign Application Priority Date

May 14, 1985 [DE] Fed. Rep. of Germany ... 3517447

April 18, 1986 [DE] Fed. Rep. of Germany ... 3613202

Signed and Sealed this

Sixth Day of September, 1988

*Attest:*

DONALD J. QUIGG

*Attesting Officer*

*Commissioner of Patents and Trademarks*